US005596865A

United States Patent [19]

Krämer

[11] Patent Number: 5,596,865

[45] Date of Patent: Jan. 28, 1997

[54] METHOD FOR THE REMOVAL AND THE FURTHER PROCESSING OF TABLETS OR PILLS OR THE LIKE DERIVED FROM A TABLET PRESS AND A DEVICE FOR PERFORMING THE METHOD

[76] Inventor: Norbert Krämer, Röntgenstrasse 68, D-64291 Darmstadt, Germany

[21] Appl. No.: 157,191

[22] PCT Filed: Jun. 9, 1992

[86] PCT No.: PCT/DE92/00468

§ 371 Date: Feb. 7, 1994

§ 102(e) Date: Feb. 7, 1994

[87] PCT Pub. No.: WO92/22278

PCT Pub. Date: Dec. 23, 1992

[30] Foreign Application Priority Data

Jun. 9, 1991 [DE] Germany ..... 41 18 878.0
Jun. 9, 1991 [DE] Germany ..... 9107053 U

[51] Int. Cl.[6] ..... B65B 63/00

[52] U.S. Cl. ..... 53/428; 53/54; 53/111 R; 53/244; 53/475; 73/865.8; 198/588; 198/812; 209/12.1; 264/40.1

[58] Field of Search ..... 53/111 R, 54, 53/122, 244, 513, 428, 475, 900; 73/865.8; 198/812, 861.2, 861.6, 588; 209/12.1, 567, 576, 577; 264/40.1, 40.4

[56] References Cited

U.S. PATENT DOCUMENTS

| | | | |
|---|---|---|---|
| 2,679,342 | 5/1954 | Fradenburgh | 53/244 X |
| 2,944,493 | 7/1960 | Bailey et al. . | |
| 3,028,713 | 4/1962 | Kennedy et al. | 53/244 X |
| 3,294,235 | 12/1966 | Pitkin et al. . | |
| 3,579,848 | 5/1971 | Hernandez et al. . | |
| 3,613,866 | 10/1971 | Arndt | 198/812 |
| 3,738,505 | 6/1973 | Harris . | |
| 3,910,737 | 10/1975 | Shimada et al. | 264/40.4 X |
| 4,094,129 | 6/1978 | List | 53/54 |
| 4,354,602 | 10/1982 | Miyoshi et al. | 209/577 X |
| 4,472,960 | 9/1984 | Motoyama et al. | 73/865.8 X |
| 4,884,463 | 12/1989 | Kay | 73/865.8 |
| 4,972,940 | 11/1990 | Gleason | 198/588 |
| 5,085,510 | 2/1992 | Mitchell | 209/577 X |
| 5,094,786 | 3/1992 | Nagashima et al. | 264/40.4 X |

FOREIGN PATENT DOCUMENTS

| | | |
|---|---|---|
| 627019 | 3/1936 | Germany . |
| 888527 | 9/1953 | Germany . |
| 964128 | 5/1957 | Germany . |
| 1018794 | 10/1957 | Germany . |
| 054819 | 1/1963 | Germany . |
| 1147349 | 4/1963 | Germany . |
| 1211994 | 3/1966 | Germany . |
| 2435289 | 5/1976 | Germany . |
| 2725393 | 12/1978 | Germany . |
| 3505657 | 9/1985 | Germany . |
| 3527186 | 2/1986 | Germany . |

*Primary Examiner*—Daniel Moon
*Attorney, Agent, or Firm*—Horst M. Kasper

[57] ABSTRACT

The invention relates to a process for removing tablets or pills or the like issuing from a tablet or pill press and processing them further in a plurality of containers (125, 126, 127) standing cramped on a restricted area. After leaving the tablet or pill press, the tablets or pills are conveyed upwards and, by gravity alone without the application of further energy, pass from top to bottom through an oblique deburring and dust-removing station (12) and a distributing guide (15) to divide the flow of tablets or pills into two partial streams which are taken to either a metal testing device (18) or a tablet or pill testing device (19) with a sample collector (22); the tablets or pills found to be faultless are taken further by gravity to a belt conveyor (107, 112) which takes the tablets or pills to and inserts them in a predetermined container (125, 126, 127).

28 Claims, 3 Drawing Sheets

METHOD FOR THE REMOVAL AND THE FURTHER PROCESSING OF TABLETS OR PILLS OR THE LIKE DERIVED FROM A TABLET PRESS AND A DEVICE FOR PERFORMING THE METHOD

TECHNICAL FIELD

The invention relates to a method for the removal and further processing of tablets or pills or the like coming from a tablet press or from a pill press into a plurality of containers, disposed on a small restricted surface support area, and to a device for the performance of the method.

STATE OF THE ART

The tablets or pills coming from a tablet press or a pill press have to be further treated in the following and be removed. It is known for this purpose to transport the tablets or pills into a deburring and dust-removing station, where the tablets or pills are usually placed with a distributing guide onto two conveyor belts which in turn transport the tablets or pills again upwardly and feed the tablets or pills either to a metal testing apparatus or to a tablet testing device. In the following, the tablets or pills are fed to a distributor system and are filled into containers, where the containers are usually brought to the filling location in a long sequential row on conveyor belts. In general, the filled containers or barrels have to be individually removed by the operating personnel.

The disadvantage of the conventional handling of the tablets or pills comprises that the tablets have to be lifted up several times on their path of removal and of further processing, be it by way of conveyor belts or be it by way of air streams.

Similarly, the known conveyors for the handling of tablets or pills require lots of space corresponding to their length for their positioning and the known conveyors are not suitable to provide the feeding of a plurality of containers on a most narrow space, where the plurality of containers are tightly packed into a small restricted area. Therefore, the different required aggregates in connection with the tablet production and pill production are disposed around the tablet press or the pill press, and therefore the overall space requirement for a tablet press or a pill press together with all required aggregates, including the filling of the tablets or pills into the containers, is substantial.

A device for the calibrated measuring and sorting of tablets has become known from the U.S. Pat. No. 3,294,235, which device measures the size of the individual tablets, wherein the tablets are transported for the performance of the measuring process downwardly by way of gravity force.

TECHNICAL PURPOSE

It is an object of the present invention to provide a method of the initially recited kind, which allows to remove and to further process tablets or pills, including the filling of the containers or barrels, on a smallest possible restricted area. Furthermore, it is an object of the invention to provide a device, which combines all aggregates, required for the removal and the further processing of the tablets or pills after the pressing process, on a smallest possible restricted area including the filling of the containers or barrels.

Presentation of the Invention and Its Advantages

The solution of the object comprises according to the invention that the tablets or pills are transported upwardly after leaving the tablet press or the pill press and then the tablets or pills are passing from top to bottom through an obliquely inclined disposed deburring and dustremoving station, as well as a distributing guide for the subdivision of the flow of tablets or pills into two partial streams based solely on the force of gravity without the application of further energy. The two partial streams are either fed to a metal testing apparatus or to a tablet testing device or to a pill testing device with a sample collector. The tablets or pills found to be faultless in the metal testing apparatus are taken further by gravity to a conveyor belt, where the conveyor belt is directed toward a predetermined container and fills the tablets or pills into the container.

An apparatus for the performance of the method comprises a standing column, where a transport device leads to the upper end of the standing column. The transport device adjoins into a deburring and dust-removing station, disposed on top of the standing column. The deburring and dust-removing station is disposed inclined downwardly and is furnished at its lower end with at least one output. The one output leads to a metal testing apparatus, disposed below the deburring and dust-removing station at the standing column. If desired, another output leads to a tablet testing device with sample collector, disposed also below the deburring and dust-removing station at the standing column. The output line from the metal testing apparatus is disposed inclined downwardly to a belt conveyor for the tablets or pills found to be faultless. The belt conveyor is disposed at the standing column.

The apparatus for removal and further processing of tablets or pills or the like, delivered from a tablet press or pill press into a plurality of container can exhibit a balance scale for the tablets or pills.

The method according to the invention is associated with the advantage that with this method a further processing and removal of the tablets or pills leaving a tablet press or pill press can be performed confined to a most restricted area by combining all processing steps including the filling of the tablets or pills, by lifting the tablets or pills only one single further time for the deburring and dust-removing process. Then the tablets or pills are passed by gravity alone through the different stations for the processing, where the different stations for the processing are disposable within a restricted area. Intermediately disposed transport conveyors for the renewed transporting upwardly of the tablets or pills for a further processing step can be dispensed with after the deburring and dust-removal.

The apparatus according to the invention is associated with the advantage that all required aggregates are combined in a respective integral coordination on a smallest space such that the individual line-up and installation of the devices, required after a tablet press or pill press, can be dispensed with. The apparatus is thereby capable to control and to fill a plurality of barrels, where the plurality of barrels is grouped like a matrix or like a field around the apparatus. The invention apparatus, combining a deburring - dust-removing station, a metal testing apparatus, a tablet testing device, possibly a balancing scale, and a transport conveyor to the containers or barrels, only requires a fraction of the space which the conventional apparatus individually require after a tablet press or a pill press. The invention method and the invention apparatus thus represent a complete removal and further processing system for tablets or pills up to the barrel.

The transport belt conveyor employed in the apparatus is associated with the advantage that the transport belt conveyor is capable to supply and fill containers standing most narrowly spaced on a restricted area and disposed in the shape of an arbitrary field or of an arbitrary matrix without that the containers have to be disposed for example along a circular path. Based on the relative movability of the two transport conveyor belts relative to each other and based on the possibility of the swivelling of the transport conveyor belts and on the reversibility of the course of direction of the transport conveyor belts, containers can be filled, which containers are, on the one hand, disposed in the swivelling radius with the largest diameter of the served area and, on the other hand, disposed below the transport conveyor belts. Based on the additional height-level adjustability of the transport belt conveyor, also containers of different height level can be filled.

Advantageously, the feeding of the bulk material onto the upper transport conveyor belt is performed by the hinge axle of the support. The upper support is swivelably supported at one end and is capable of being rotated in a horizontal direction along a circular path. The rotation axis is disposed perpendicular to the upper transport conveyor belt. The lower support together with the lower transport conveyor belt in the region of one of its ends is shiftably disposed at the upper support.

BRIEF DESCRIPTION OF THE DRAWING showing that

Figure 1:
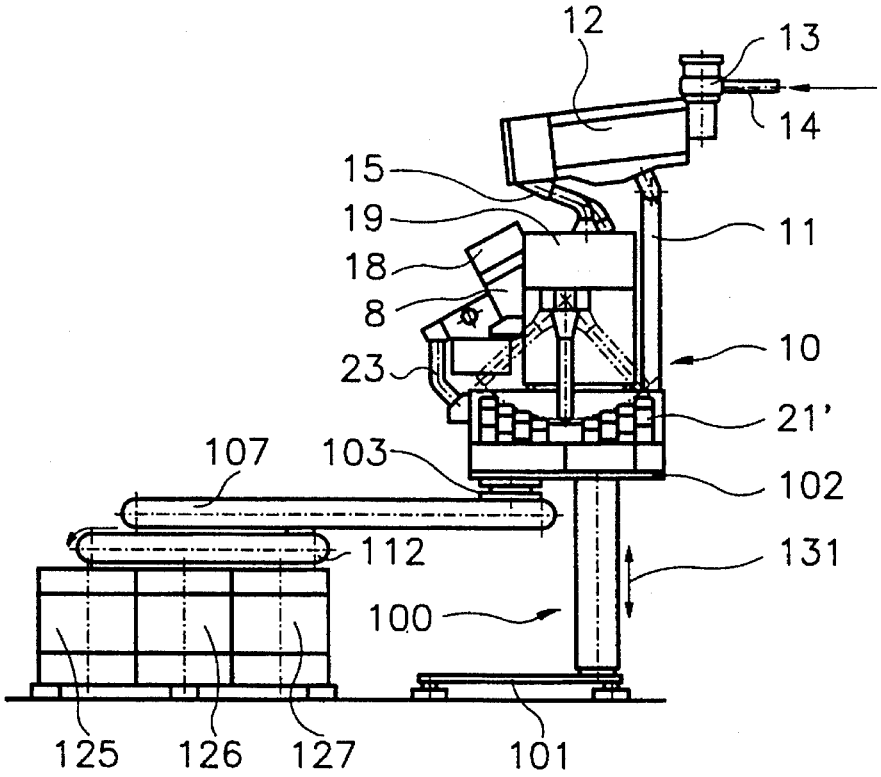
FIG. 1 is a side elevational view of the device.

The device 10 comprises a standing column 100 on a foot 101. The standing column 100 can be a lifting column and can carry a support 102. A column 11 is attached on the support 102. The column 11 exhibits at its upper end an inclined disposed deburring and dust-removing station 12. A filling funnel 13 with a feed line 14 is disposed at the upper end of the deburring and dust-removing station 12. The feed line 14 can be provided as a venturi nozzle or as a transport conveyor belt. The deburring and dust-removing station 12 exhibits at its lower end preferably a distributing guide 15 for the subdivision of the tablet stream or of the pill stream into two partial streams. The one partial stream is fed to a metal testing apparatus 18 through a distributing guide output 16 by way of force of gravity. The metal testing apparatus 18 is disposed with respect to its height level below the lower output of the deburring and dust-removing station 12. The second partial stream is fed also by way of force of gravity through a distributing guide output 17 to a tablet testing device 19. The tablets are tested according to different parameters, such as weight, height level, thickness, diameter, and hardness, in the tablet testing device 19, and the tablets are sorted by way of an apportioning device 20 and are placed into different sample containers 21, 21', also based on the force of gravity. The sample containers 21, 21' are disposed in a sample collector, where the sample collector is disposed on a table 22 of the tablet testing device 19. The table 22 is preferably slidable in the x-y plane in a horizontal direction relative to the support 102.

The tablets or pills can in addition be weighed prior to or after the metal testing apparatus 18.

The tablets found to be good and acceptable in the metal testing apparatus 18 are delivered, based on gravity force, through the output line 23 further to a transport belt conveyor 107, 112. The transport belt conveyor 107, 112 is directed to a predetermined container 125, 126, 127 or barrel for receiving the tablets or pills and fills the tablets or pills into the corresponding container. The tablets found to be not acceptable are sorted out and fall into a waste container 30.

The support 102, which can be provided adjustable in its height level, carries all the aggregates, required for the removal and further processing, including the transport belt conveyor 107, 112. The tablets or pills pass through all aggregates only based on the force of gravity and are lifted only once to the height level of the filling funnel 13 at the input of the deburring and dust-removing station 12 by way of the feed line 14.

Figure 2:
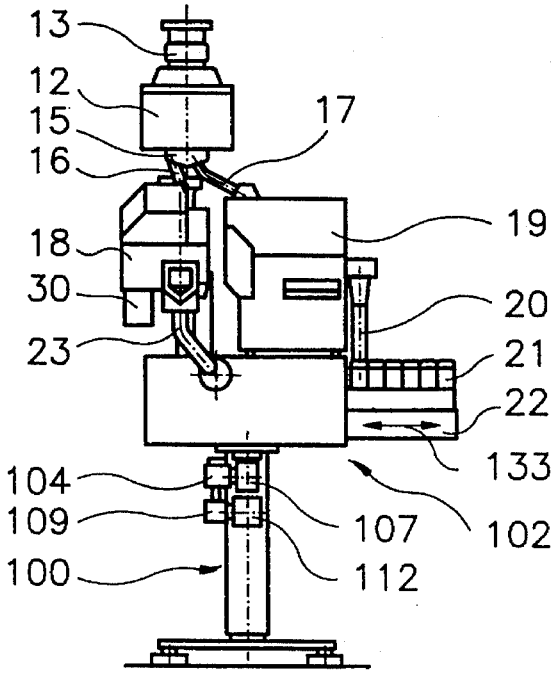
FIG. 2 is a view, rotated by 90°, of the device according to FIG. 1.
Figure 3:
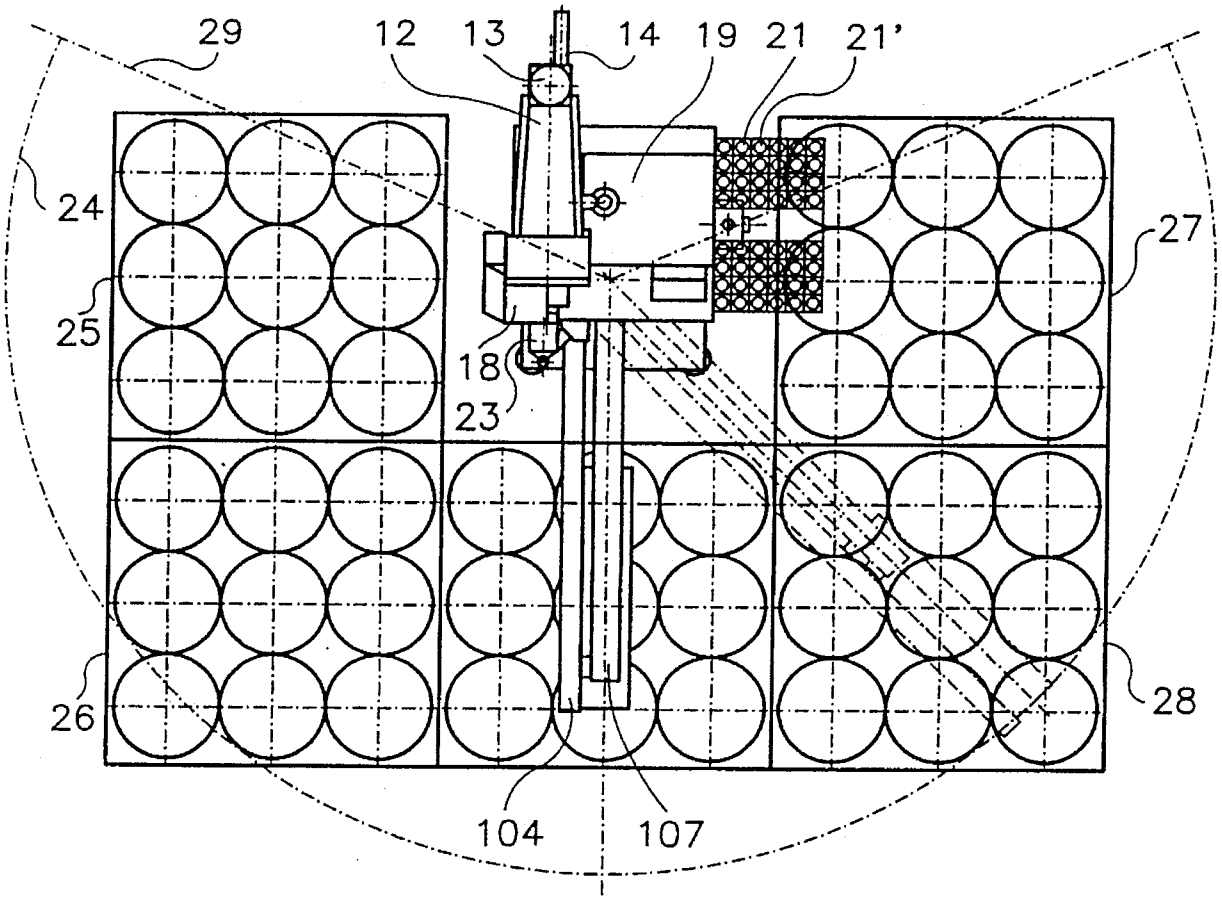
FIG. 3 is a top plan view onto FIG. 1 with the representation of the feeding radius of the transport conveyor device into the containers or barrels.

A top plan view onto the embodiment of FIGS. 1 and 2 is shown in FIG. 3. The transport belt conveyor can fill a plurality of containers disposed within a radius 29 of action, wherein the plurality of containers is disposed within the range 24 of action of the transport belt conveyor 107, 112, for example, disposed on pallets 25, 26, 27, 28. It can in particular be gathered from this figure that the apparatus can be directed to and can fill a plurality of containers or barrels, according to a sequence of control criteria, in a restricted area.

Figure 4:
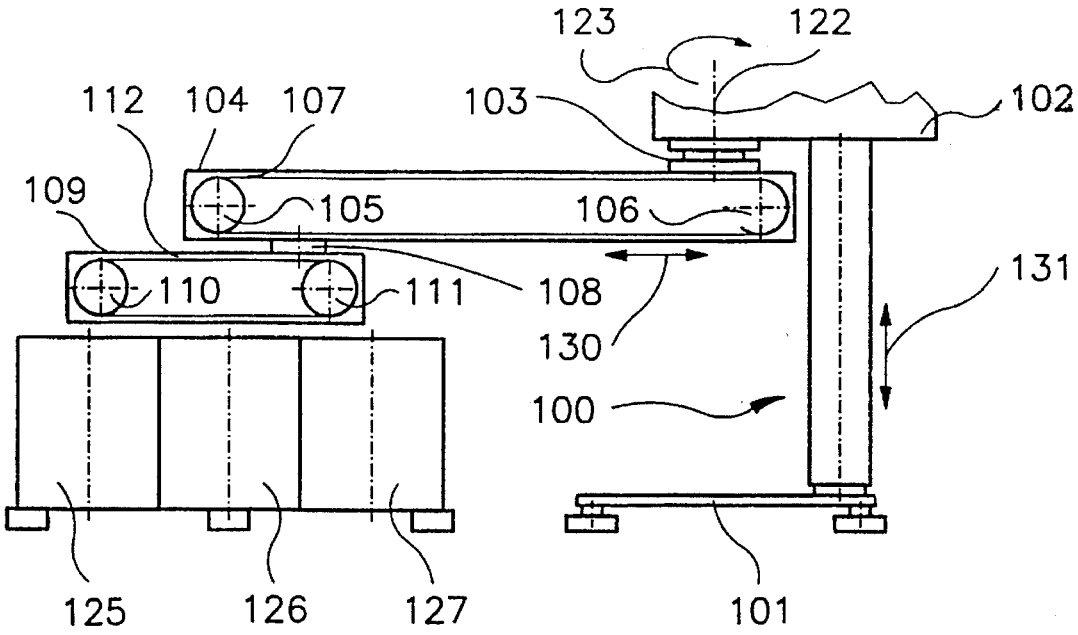
FIG. 4 is a view of the transport belt conveyor, comprising in principle two transport conveyor belts, where the transport belt conveyor is attached at the lifting column of the apparatus, where the transport belt conveyor is swivelable in the horizontal direction, and where the transport belt conveyor is movable to different height levels.
Figure 5:
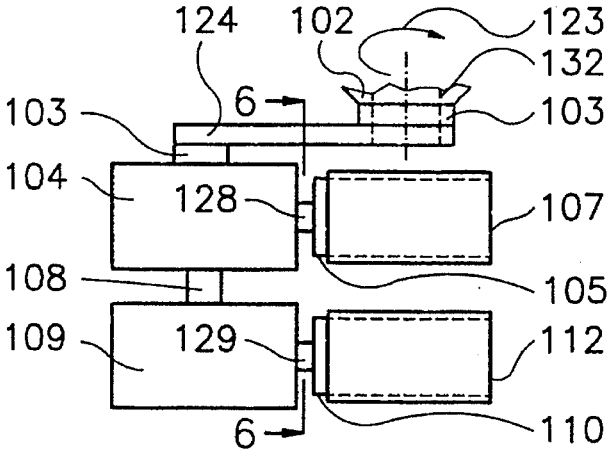
FIG. 5 is a front elevational view of the apparatus of FIG. 4.
Figure 6:
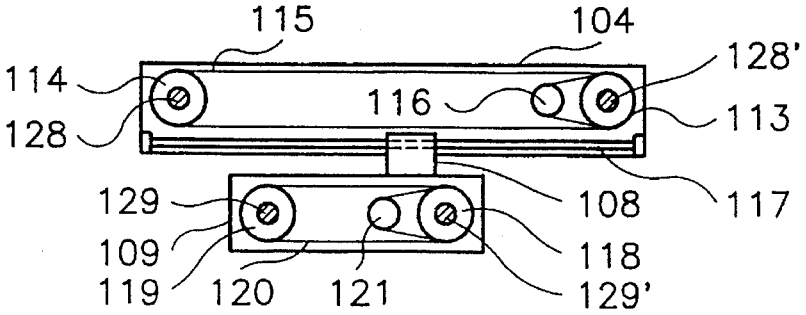
FIG. 6 is a sectional view along section line 6—6 of FIG. 5 upon elimination of the coverings of the box-shaped supports and of the support arm of the upper support.

According to FIGS. 4 through 6, the transport belt conveyor includes an upper elongated, box-shaped support, which is preferably provided as a box 104. In each case a deflection roller 105, 106 is disposed on the side at the ends of the box 104. A transport conveyor belt 107 is looped around the deflection rollers 105, 106. The deflection rollers 105, 106 are positioned on shafts 128, 128' for being driven. The shafts 128, 128' are supported in a suitable way within the box 104. Further deflection rollers 113, 114 are sitting on the shafts 128, 128' within the box 104. A drive belt 115 is running on the further deflection rollers 113, 114. The deflection roller 113 or, respectively, the shaft 128' is driven by way of an electric motor 116. The electric motor 116 is disposed in a space-saving manner within the free space between the carrying run and the return run of the drive belt 115. In this way, the two shafts 128, 128' and, thus, the two deflection rollers 105, 106 for the transport belt 107 are driven.

A further longitudinally disposed, automatic drive is furnished within the box 104. The automatic drive can for example be a threaded spindle 117 or a gear rack or a drive belt, disposed longitudinally inside the box 104. A linearly shiftable slider carriage 108 is disposed at this automatic drive. The slider carriage 108 protrudes downwardly out of the box 104 and a second elongated box-shaped support is disposed at the carriage slider 108. The second elongated box-shaped support is preferably also a box 109, where the box 109 can be constructed similar to the box 104. The carriage slider 108 is preferably engaging at one end of the box 109 and supports the box 109 in a horizontal position.

Similarly, the lower support 109 exhibits at its ends also on its sides in each case a deflection roller 110, 111, wherein a transport conveyor belt 112 is again looped around the deflection rollers 110, 111. For driving the deflection rollers 110, 111, these deflection rollers 110, 111 are supported on shafts 129, 129'. The shafts 129, 129' are also supported in a suitable way within the box 109. Further deflection rollers 118, 119 are sitting on the shafts 129, 129' within the box 109. A drive belt 120 runs over the further deflection rollers 118, 119. The deflection roller 118 or, respectively, the shaft 129' is driven by way of an electric motor 121. The electric motor 121 is disposed in a space-saving manner within the free space between the carrying run and the return run of the drive belt 120. In this way, the two shafts 129, 129' and, thus, the two deflection rollers 110, 111 for the transport belt 112 are driven in like manner. The two boxes 104, 109 together with the transport conveyor belts 107, 112 can be similar with the exception of different lengths.

The boxes 104, 109 and the two transport belts 107 and 112 are disposed on top of each other along their sides and are aligned parallel to each other and are preferably directed in a horizontal direction. Upon driving of the slider carriage 108 by way of its own motor (not illustrated) or by way of the gear rack or threaded spindle 117, the lower transport conveyor belt is moved forwardly and backwardly in two directions in longitudinal direction according to the moving direction double arrow 130 below the upper transport conveyor belt 107. Simultaneously, the running direction of the transport conveyor belts can be controlled as desired. According to the relative position illustrated in FIG. 1 of the two transport conveyor belts 107, 112 relative to each other, the outermost left container 125 is filled upon rotation of the two transport conveyor belts in counterclockwise direction. In case of a rotation of the upper transport conveyor belt 107 in counterclockwise direction, but a rotation of the lower transport conveyor belt 102 in clockwise direction, the right container 127 is being filled.

A support arm 124 engages at one of its ends at the upper box 104. The support arm 124 projects into the direction of the upper transport conveyor belt 107. A hinge 103 engages at the end of the support arm 124. The rotation axis 122 of the hinge 103 runs perpendicular to the plane of the center region of the end of the transport conveyor belt 107 and is standing on the transport conveyor belt 107. The hinge 103 is attached in a suitable way at the support 102. The support 102 is mounted on the lifting column 100. The lifting column 100 rests on the foot 101. The support 102 carries, in addition to the remaining aggregates, also the boxes 104, 109 including the transport conveyor belts 107, 112.

The hinge is furnished with a feed 132 for the bulk material. The hinge 103 is preferably of tubular shape and the feed 132 is thus performed through the hinge 103. In this way, the bulk material is transported in an advantageous way directly onto the upper transport conveyor belt 107 through the rotation axle 122 of the hinge 103. The support 102 is movable for changing a height level relative to the lifting column 100 according to the motion direction double arrow 131.

Commercial Application

The method according to the present invention and the invention apparatus are in particular suitable for the removal and the further processing in a most restricted space of tablets or pills delivered by a tablet press or pill press, wherein the tablets or pills are to be filled into containers or barrels.

| List of Reference Numerals | |
|---|---|
| 10 | filling station |
| 11 | column |
| 12 | deburring and dust-removing station |
| 13 | filling funnel |
| 14 | feed line |
| 15 | distributing guide |
| 16, 17 | distributing guide outputs |
| 18 | metal testing apparatus |
| 19 | tablet testing device |
| 20 | apportioning pipe |
| 21, 21' | sample container |
| 22 | sample collector in shape of a table |
| 23 | output line |
| 24 | range of action |
| 25, 26, 27, 28 | pallets |
| 29 | radius of action |
| 30 | waste container |
| 100 | lifting column |
| 101 | foot of the lifting column |
| 102 | support |
| 103 | hinge |
| 104, 109 | box-shaped supports |
| 105, 106, 110, 111, 113, 114 | deflection rollers |
| 107, 112 | transport conveyor belts |
| 108 | slider carriage |
| 115, 120 | drive belts |
| 116, 121 | electric motors |
| 117 | gear rack or threaded spindle |
| 118, 119 | deflection rollers |
| 122 | rotation axis |
| 123, 130, 131, 133 | moving direction arrows |
| 124 | support arm |
| 125, 126, 127 | containers |
| 128, 128', 129, 129' | shafts |
| 132 | feed |

I claim:

1. Method for removal and further processing of tablets or pills derived from a tablet press or pill press into a plurality of closely spaced containers standing on a restricted area, comprising the steps of discharging the tablets or pills from a tablet press or pill press, whereby the tablets or pills form a tablet stream or pill stream;

transporting the tablet stream or pill stream upwardly;

passing the tablet stream or pill stream, driven by gravity alone without adding additional energy, from an upper position to a lower position through a deburring and dust-removing station (12);

passing the tablet stream or pill stream driven by gravity alone through a distributing guide (15) for subdividing the tablet stream or pill stream into two partial streams;

feeding the partial streams driven by gravity alone to a metal testing apparatus (18) and to a tablet or pill testing device (19);

placing the tablets or pills, found to be good and acceptable in the metal testing apparatus (18), based on gravity onto a transport belt conveyor (107, 112);

directing the transport belt conveyor (107, 112) to a predetermined container (125, 126, 127) being one of the plurality of containers; and filling the tablets or pills from the transport belt conveyor (107, 112) into the predetermined container (125, 126, 127).

2. Method according to claim 1, further comprising the step of weighing the tablets or pills in addition prior to feeding same to the metal testing apparatus (18).

3. Method according to claim 1, further comprising the steps of weighing the tablets or pills in addition after passing through the metal testing apparatus (18) and prior to being placed onto the transport belt conveyor (107, 112);

adjusting a height level of the transport belt conveyor to a height of the plurality of containers;

closely placing the plurality of containers in a restricted area and transporting the tablets or pills along an inclined plane downward;

filling tablets or pills sorted by the tablet or pill testing device, based on gravity into sample containers disposed in the sample collector;

discarding the pills found to be not good.

4. Method according to claim 1, further comprising a sample collector (22) associated with the tablet or pill testing device.

5. Apparatus for removal and further processing of tablets or pills, delivered from a tablet press or pill press into a plurality of containers for performing the method according to claim 1, wherein said apparatus comprises a standing column (100), wherein a transport device (13, 14) leads to the upper end of the standing column (100), wherein the transport device (13, 14) adjoins into a deburring and dust-removing station (12) disposed on top of the standing column (100) for feeding a tablet stream or pill stream by gravity alone into the deburring and dust-removing station (12), wherein the deburring and dust-removing station (12) is disposed inclined downwardly, and wherein at least one output (16, 17) is furnished at the lower end of the deburring and dust-removing station (12), wherein one output (16) of the deburring and dust-removing station (12) leads to a metal testing apparatus (18), disposed below the deburring and dust-removing station (12) at the standing column (100) for feeding the tablet stream or pill stream by gravity alone to the metal testing apparatus (18), and wherein a second output (17) of the deburring and dust-removing station (12) leads to a tablet testing device (19) with a sample collector (22) for feeding the tablet stream or pill stream by gravity alone to the tablet testing device (19), also disposed below the deburring and dust-removing station (12) at the standing column (100), wherein an output line (23) leads from the metal testing apparatus (18) for the tablets or pills found to be good and acceptable inclined downwardly onto a transport belt conveyor (107, 112), wherein the tablets or pills found to be not good are discarded, wherein the transport belt conveyor (107, 112) is disposed at the standing column (100), and wherein the standing column (100) is preferably a lifting column (100).

6. Apparatus according to claim 5, wherein the deburring and dust-removing station (12), the metal testing apparatus (18), and the tablet testing device (19) with the sample collector (22), as well as the transport belt conveyor (107, 112) are disposed on a support (102), wherein the support (102) is disposed shiftable for changing its height level at the standing column (100).

7. Apparatus according to claim 5, wherein the apparatus exhibits a balance scale (8) for the tablets or pills.

8. Apparatus according to claim 5, wherein a) the transport belt conveyor (107, 112) exhibits an elongated, box-shaped support (104), wherein in each case a deflection roller (105, 106) is disposed laterally at the ends of the elongated, box-shaped support (104), and wherein a transport conveyor belt (107) is looped around the deflection rollers (105, 106), b) a second elongated, box-shaped support (109) is disposed below the support (104), wherein the second elongated, box-shaped support (109) exhibits laterally on its ends also a deflection roller (110, 111), wherein a transport conveyor belt (112) is looped around the deflection rollers (110, 111), wherein the two transport conveyor belts (105, 106, 107; 110, 111, 112) are disposed on top of each other along their longitudinal sides, c) the lower support (109) is movably suspended at the upper support (104) and is movable together with the lower transport conveyor belt (110, 111, 112) relative to the upper support (104) in longitudinal direction of the transport conveyor belts (107, 112), however, independent of the motion of the transport conveyor belts, d) the running direction of the lower transport conveyor belt (112) is reversible.

9. Apparatus according to claim 8, wherein the deflection rollers (105, 106; 110, 111) are placed on shafts (128, 129), horizontally protruding from the supports (104, 109), for the purpose of driving the transport conveyor belts (107, 112), wherein also deflection rollers (113, 114; 118, 119) are disposed on the shafts (128, 129) within the supports (104, 109), wherein drive belts (115, 120) are looped around the deflection rollers (113, 114; 118, 119), wherein in each case one of the deflection rollers (113, 118) is drivable within the supports (104, 109) by way of an electric motor (116, 121), wherein the electric motors (116, 121) are disposed within the free space between the respective carrying run and the return run of the drive belts (115, 120).

10. Apparatus according to claim 8, wherein the upper support is suspended from a hinge (103), wherein the hinge (103) is supported at a support (102), wherein the support (102) can be moved for changing height level at a lifting column (100) for the adjustability of the height level of the transport belt conveyor.

11. Apparatus according to claim 8, wherein the length of the lower transport conveyor belt (110, 111, 112) amounts to between half and three quarters of the upper transport conveyor belt (105, 106, 107), and is preferably half as long as the upper transport conveyor belt (105, 106, 107).

12. Apparatus according to claim 8, wherein the upper elongated, box-shaped support (104) is supported swivelable at one end on a circular path in the horizontal plane, wherein the rotation axis (123) is placed onto and perpendicular to the upper transport conveyor belt (107), and wherein the feed of the bulk material onto the uppermost transport conveyor belt (107) is performed by the rotation axle (123) of the support (104), and wherein the lower support (109) in the area of its ends is shiftably disposed at the upper support (104), and wherein the transport conveyor belts (105, 106, 107; 110, 111, 112) are disposed parallel superpositioned and linearly movable relative to each other in direction of their longitudinal axes.

13. Apparatus according to claim 12, further comprising a gear rack or a threaded spindle (117) is disposed within the upper support (104) in a longitudinal direction, wherein a self-driven slider carriage (108) runs shiftably on the threaded spindle (117), wherein the lower support (109) is attached together with the lower transport conveyor belt (112) at the slider carriage (108), wherein driving the slider carriage is performed mechanically within the upper support by way of a drive belt, and wherein the slider carriage is guided and supported in a rail-like slider carriage guide.

14. An apparatus for removal and further processing of tablets and pills, delivered from a tablet and pill press into a plurality of containers, comprising a standing column (100) having an upper end and;

a transport device (13, 14) leading to the upper end of the standing column (100);

a deburring and dust-removing station (12) having an upper end and a lower end and disposed on the upper end of the standing column (100), wherein an upper end of the transport device (13, 14) adjoins into the deburring and dust-removing station (12), and wherein the deburring and dust-removing station (12) is disposed downwardly inclined for feeding a tablet stream or pill stream by gravity alone into the deburring and dust-removing station (12);

at least one output (16) furnished at the lower end of the deburring and dust-removing station (12);

a metal testing apparatus (18) disposed below the deburring and dust-removing station (12) at the column (100), wherein the output (16) of the deburring and dust-removing station (12) leads to the metal testing apparatus (18) for feeding the tablet stream or pill stream by gravity alone to the metal testing apparatus an output line (23) disposed at the metal testing apparatus (18);

a first transport belt conveyor (107), and a second transport belt conveyor (112) disposed at the standing column, wherein the output line (23) is inclined in a direction of one of the first transport belt conveyor (107) and of the second transport belt conveyor (112);

closely spaced containers disposed below the transport belt conveyors (107, 112);

wherein the tablets or pills found to be good and acceptable in the metal testing apparatus (18) are discharged from the metal testing apparatus (18) onto the first transport belt conveyor (107) and onto the second transport belt conveyor (112) and then placed into a predetermined container of the closely spaced containers and wherein the tablets or pills found to be not good and acceptable are discarded.

15. The apparatus according to claim 14, further comprising a balance scale (8) for weighing the tablets and pills delivered by the deburring and dust-removing station (12).

16. The apparatus according to claim 14, further comprising a balance scale (8) for weighing the tablets and pills delivered by the metal testing apparatus (18).

17. The apparatus according to claim 14, wherein the standing column (100) is a lifting column.

18. The apparatus according to claim 14, further comprising a second output (17) of the deburring and dust-removing station (12);

a tablet testing device (19) with a sample collector (22) disposed below the deburring and dust-removing station (12) at the standing column (100), wherein the second output (17) leads to the tablet testing device (19).

19. The apparatus according to claim 18, further comprising a support (102) disposed at the standing column (100), where the support (102) is adjustable in height by shifting, wherein the deburring and dust-removing station (12), the metal testing apparatus (18), and the tablet testing device (19) with the sample collector (22), as well as the transport belt conveyor (107, 112) are disposed on said support (102).

20. The apparatus according to claim 14, wherein the first transport belt conveyor (107) comprises a first elongated, box-shaped support (104) having a first end and a second end, a first deflection roller (105) disposed laterally at the first end of the first elongated, box-shaped support (104), a second deflection roller (106) disposed laterally at the second end of the first elongated, box-shaped support (104, a first transport conveyor belt (107) looped around the first deflection roller (105) and the second deflection roller (106);

and wherein the second transport belt conveyor (112) comprises a second elongated, box-shaped support (109) disposed below the first elongated, box-shaped support (104) and having a first end and a second end, a third deflection roller (110) disposed laterally at the first end of the second elongated, box-shaped support (109), a fourth deflection roller (111) disposed laterally at the second end of the second elongated, box-shaped support (109), a second transport conveyor belt (112) looped around the third deflection roller (110) and the fourth deflection roller (111);

wherein the first transport belt conveyor (107) and the second transport belt conveyor (112) are disposed on top of each other along their longitudinal sides, wherein the second elongated, box-shaped support (109) is movably suspended from the first elongated, box-shaped support (104) and is movable relative to the first elongated, box-shaped support (104) in longitudinal direction of the first transport conveyor belt (107), and wherein a motion of the second transport conveyor belt (112) is independent of a motion of the first transport conveyor belt (107), and wherein a running direction of the first transport conveyor belt (107) and the second transport conveyor belt (112) is reversible.

21. The apparatus according to claim 16, further comprising a first shaft (128) and a third shaft (128') horizontally protruding from the first elongated, box-shaped support (104) and receiving the first deflection roller (105) and the second deflection roller (106), respectively, for driving the first transport conveyor belt (107);

a second shaft (129) and a fourth shaft (129') horizontally protruding from the second elongated, box-shaped support (109) and receiving the third deflection roller (110) and the fourth deflection roller (111), respectively, for driving the second transport conveyor belt (112);

a fifth deflection roller (113) disposed on the first shaft (128) within the first elongated, box-shaped support (104);

a sixth deflection roller (114) disposed on the third shaft (128') within the first elongated, box-shaped support (104);

a seventh deflection roller (118) disposed on the second shaft (129) within the second elongated, box-shaped support (109);

an eighth deflection roller (119) disposed on the fourth shaft (129') within the second elongated, box-shaped support (109);

a first drive belt (115) looping around the fifth deflection roller (113) and the sixth deflection roller (114) and having a free space between a carrying run and a return run; a second drive belt (120) looping around the seventh deflection roller (118) and the eighth deflection roller (119) and having a free space between a carrying run and a return run;

a first electric motor (116) driving the fifth deflection roller (113) within the first elongated, box-shaped support (104) and disposed within the free space between the carrying run and the return run of the drive belt (115); a second electric motor (121) driving the seventh deflection roller (118) within the second elongated, box-shaped support (109) and disposed within the free space between the carrying run and the return run of the drive belt (120).

22. The apparatus according to claim 16, further comprising a support (102) disposed at the column (100);

a hinge (103) supported at the support (102);

wherein the first elongated, box-shaped support (104) is suspended from the hinge (103), and wherein the support (102) can be moved for changing height level at the standing column (100) for adjusting height levels of the first transport belt conveyor (107) and the second transport belt conveyor (112).

23. The apparatus according to claim 16, wherein the length of the second transport conveyor belt (112) amounts to between one half and three quarters of the first transport conveyor belt (107), and is preferably one half as long as the first transport conveyor belt (107).

24. The apparatus according to claim 20, wherein the first end of the first elongated, box-shaped support (104) is supported swivelable on a circular path in a horizontal plane, wherein a rotation axis (123) of the first elongated, box-shaped support (104) swivelling in the horizontal plane is placed perpendicular to the first transport conveyor belt (107), and wherein the tablets or pills found to be good and acceptable are fed onto the first transport conveyor belt (107) through a tubular-shaped hinge (103) rotated around the rotation axis (123) of the first elongated, box-shaped support (104), and wherein the second elongated, box-shaped support (109) in the area of its first end is shiftably disposed at the first elongated, box-shaped support (104), and wherein the first transport conveyor belt (107) with the first deflection roller (105) and the second deflection roller (106), and the second transport conveyor belt (112) with the third deflection roller (110) and the fourth deflection roller (111) are superpositioned.

25. The apparatus according to claim 24, further comprising an automatic drive (117) disposed within the first elongated, box-shaped support (104) in a longitudinal direction;

a self-driven slider carriage (108) running shiftably on said automatic drive (117), wherein the second elongated, box-shaped support (109) is attached together with the second transport conveyor belt (112) at the self-driven slider carriage (108), and wherein the self-driven slider carriage (108) is driven mechanically within the first elongated, box-shaped support (104);

a rail-like slider carriage guide, wherein the self-driven slider carriage is guided and supported in the rail-like slider carriage guide.

26. The apparatus according to claim 25, wherein the automatic drive is furnished by a gear rack.

27. The apparatus according to claim 25, wherein the automatic drive is furnished by a threaded spindle.

28. An apparatus for removal and further processing of tablets and pills, delivered from a tablet and pill press into a plurality of containers, comprising a standing column (100) having an upper end and carrying a support provided with adjustable height level and disposed at the upper end of the standing column;

a column (11) attached to the support (102);

a transport device (13, 14) leading to a top of the column (11);

a deburring and dust-removing station (12) having an upper end and a lower end and disposed on the top of the column (11), wherein an upper end of the transport device (13, 14) adjoins into the deburring and dust-removing station (12), and wherein the deburring and dust-removing station (12) is disposed downwardly inclined for feeding a tablet stream or pill stream by gravity alone into the deburring and dustremoving station (12);

at least one output (16) furnished at the lower end of the deburring and dust-removing station (12);

a metal testing apparatus (18) disposed below the deburring and dust-removing station (12) at the column (11), wherein the output (16) of the deburring and dust-removing station (12) leads to the metal testing apparatus (18) for feeding the tablet stream or pill stream by gravity alone to the metal testing apparatus (18);

an output line (23) disposed at the metal testing apparatus (18);

a first transport belt conveyor (107), and a second transport belt conveyor (112) disposed at the support (102) carried by the standing column, wherein the output line (23) is inclined in a direction of one of the first transport belt conveyor (107) and second transport belt conveyor (112);

closely spaced containers disposed below the transport belt conveyors (107, 112);

wherein tablets or pills found to be good and acceptable in the metal testing apparatus (18) are discharged from the metal testing apparatus (18) onto the first transport belt conveyor (107) and onto the second transport belt conveyor (112) and then placed into a predetermined container of the closely spaced containers and wherein tablets or pills found to be not good and acceptable are discarded.

* * * * *